US010020593B1

(12) United States Patent
Yngvesson et al.

(10) Patent No.: US 10,020,593 B1
(45) Date of Patent: Jul. 10, 2018

(54) SYSTEM AND METHOD FOR TERAHERTZ INTEGRATED CIRCUITS

(71) Applicants: Sigfrid K. Yngvesson, Leverett, MA (US); Martin Muthee, Randolph, MA (US)

(72) Inventors: Sigfrid K. Yngvesson, Leverett, MA (US); Martin Muthee, Randolph, MA (US)

(73) Assignee: THE UNIVERSITY OF MASSACHUSETTS, Boston, MA (US)

( * ) Notice: Subject to any disclaimer, the term of this patent is extended or adjusted under 35 U.S.C. 154(b) by 246 days.

(21) Appl. No.: 14/710,891

(22) Filed: May 13, 2015

Related U.S. Application Data

(60) Provisional application No. 61/994,394, filed on May 16, 2014.

(51) Int. Cl.
*H01Q 21/00* (2006.01)
*H01Q 1/50* (2006.01)

(52) U.S. Cl.
CPC ..... *H01Q 21/0006* (2013.01); *H01Q 1/50* (2013.01); *H01Q 21/0087* (2013.01)

(58) Field of Classification Search
CPC ... H01Q 21/0006; H01Q 1/50; H01Q 21/0087
USPC ..... 343/771
See application file for complete search history.

(56) References Cited

U.S. PATENT DOCUMENTS 3,988,272 A * 10/1976 Watts ..... C08F 299/0442 523/502
5,148,124 A * 9/1992 Goff ..... H01P 1/227 219/209
2006/0135110 A1* 6/2006 Przybysz ..... B82Y 10/00 455/331
2009/0160728 A1* 6/2009 Emrick ..... H01Q 1/243 343/893
2009/0295644 A1* 12/2009 Curran ..... H01B 1/24 343/700 MS
2010/0200275 A1* 8/2010 Kim ..... H02G 5/063 174/21 JS (Continued)

OTHER PUBLICATIONS

Muthee, Terahertz Radiation From Single Walled Carbon Nanotubes, Master's Thesis, pp. 25, 40, and 85-86, Sep. 2011, University of Massachusetts, Amherst, MA.*

(Continued)

*Primary Examiner* — Dieu H Duong
*Assistant Examiner* — Bamidele A Jegede
(74) *Attorney, Agent, or Firm* — Burns & Levinson LLP; Orlando Lopez

(57) ABSTRACT

A system that includes an electromagnetic wave transmission structure having a first end and a second end, conducting components, the conducting components selected from at least one of a network of carbon nanotubes, at least one strip of palladium, at least one strip of platinum or at least one exfoliated graphene sheet, deposited across a location in a wave transmission section of the wave transmission structure (also referred to as a gap), and at least one antenna electromagnetically coupled to the electromagnetic wave transmission structure at one of the first or second end, the antenna and the electromagnetic wave transmission structure being formed by integrated circuit techniques is disclosed.

17 Claims, 13 Drawing Sheets

(56) References Cited

U.S. PATENT DOCUMENTS

| | | | | |
|---|---|---|---|---|
| 2012/0080073 | A1* | 4/2012 | Kotter | H01Q 1/248 136/246 |
| 2012/0182178 | A1* | 7/2012 | Pesetski | H04B 1/28 342/179 |
| 2014/0144009 | A1* | 5/2014 | Chattopadhyay | H01P 11/001 29/600 |

OTHER PUBLICATIONS

Hartmann et al., "Terahertz Science and Technology of Carbon Nanomaterials" https://arxiv.org/abs/1311.6035, 2013.
Muthee et al., "Terahertz radiation from antenna-coupled Single Walled Carbon Nanotubes" http://ieeexplore.ieee.org/document/6105081/?reload=true, 2011.
Jofre et al., "The 'Challenging' world of Terahertz radiation and Imaging" http://www.eucap2011.org/files/InvitedPaper_Jofre.pdf, 2011.
Muthee et al., "On-Chip THz Spectroscopy of Polyhydroxybutyrate (PHB) powder" http://ieeexplore.ieee.org/document/6665766/?section=abstract, 2013.
Muthee et al., "Antenna-coupled terahertz radiation from joule-heated single-wall carbon nanotubes" http://aip.scitation.org/doi/full/10. 1063/1.3660346, 2011.
Krane "Preparation of Graphene" http://www.physik.fu-berlin.de/einrichtungen/ag/ag-reich/lehre/Archiv/ss2011/docs/Nils_Krane-Handout.pdf, 2011.
Yngvesson et al., "Microwave and terahertz detection in bundles of single-wall carbon nanotubes" 33rd International Conference on Infrared, Millimeter and Terahertz Waves, 2008.

* cited by examiner

SYSTEM AND METHOD FOR TERAHERTZ INTEGRATED CIRCUITS

CROSS REFERENCE TO RELATED APPLICATIONS

This application claims priority of U.S. Provisional Application Ser. No. 61/994,394, entitled SYSTEM AND METHOD FOR TERAHERTZ INTEGRATED CIRCUITS USING CARBON NANOTUBES SOURCES, filed on May 16, 2014, which is incorporated by reference herein in its entirety for all purposes.

STATEMENT REGARDING FEDERALLY SPONSORED RESEARCH OR DEVELOPMENT

This invention was made partially with U.S. Government support from the National Science Foundation under Grant No. ECS-1028510. The Government has certain rights in the invention.

BACKGROUND

These teachings relate generally to terahertz integrated circuits using carbon nanotube sources.

Terahertz radiation (frequencies from 300 GHz to 10 THz; wavelengths 1 mm to 30 μm; note that 1 THz=1,000 GHz)) has primary potential applications to security imaging, molecular and liquid spectroscopy and bio-medical imaging. Terahertz spectroscopy and imaging systems require a terahertz source and a terahertz detector, and several versions of such sources and detectors exist, some of which have been commercialized: 1) Quantum cascade lasers, used by Kim et al. and Lee et al. while compact and capable of producing multi-mW powers, are limited to operating at cryogenic temperatures and produce radiation patterns that are difficult to control. 2) Sources of the TDS type ("Time-Dependent Spectroscopy") used for medical imaging by e.g. Fitzgerald et al. and Photomixers used for the type of same type of applications by e.g. Brown et al. operate at 300 K and have average output powers less than or about equal to 1 μW but require visible/Near Infra Red lasers that are neither compact nor inexpensive (Teraview, Inc.; >100 k$). 3) Schottky barrier diode multiplier sources (Commercially available; Virginia Diodes) can deliver 10's of μW to 100's of μW of power between 1 and 2 THz (up to several mW just below 1 THz) and are more compact but require special diode and circuit fabrication steps that lead to a price range in the several tens of k$. They also rely on the availability of a high power source at millimeter waves which adds to the cost. 4) Sources based on plasma effects in FET/HEMT channels produce broadband radiation with output powers ~1 μW. Their fabrication requires complex processing to reach that power level. THz gas lasers are well-known THz sources with output power up to over 100 mW (Coherent DEOS). Gas lasers are very large (order of meters) and commercial versions sell for in excess of $300 k.

At microwave frequencies (up to 200 GHz at present) both sources and detectors (usually transistors), as well as other devices, are typically fabricated as monolithically integrated circuits (MMICs) on a single chip. These can be mass-produced and wireless technology makes heavy use of such MMICs, for example. Very little work has been performed on analogous integrated circuits for the THz range (Terahertz Integrated Circuits, TICs), especially above 1 THz. Microstrip lines were previously used for materials spectroscopy of very small amounts of lactose and biomolecules in water solution with Terahertz Time-Domain Spectroscopy (TDS), but TDS requires expensive short-pulse lasers and the overall TDS system is much less compact than our system. Terahertz detector technology has recently demonstrated detector arrays for THz imaging that are fabricated in inexpensive silicon MOS technology, so far up to 1 THz. The sources employed in these imaging systems are still not feasible to fabricate in any inexpensive technology.

There is a need for easy to fabricate terahertz integrated circuits that can be used in the above and similar applications.

BRIEF SUMMARY

Terahertz integrated circuits (TICs) using carbon nanotube sources and methods of fabricating them are disclosed herein below.

In one or more embodiments, the system of these teachings includes an electromagnetic wave transmission structure having a first end and a second end, conducting components, the conducting components selected from at least one of a network of carbon nanotubes, at least one strip of palladium, at least one strip of platinum or at least one exfoliated graphene sheet, deposited across a location in a wave transmission section of the wave transmission structure (also referred to as a gap), and at least one antenna electromagnetically coupled to the electromagnetic wave transmission structure at one of the first or second end, the antenna and the electromagnetic wave transmission structure being formed by integrated circuit techniques.

In one or more embodiments, the method of these teachings includes depositing conductive components, the conducting components selected from at least one of a network of carbon nanotubes, at least one strip of palladium or at least one strip of platinum, across a gap in an electromagnetic wave transmission structure and coupling at least one antenna to the electromagnetic wave transmission structure to a first or second end of the electromagnetic wave transmission structure, the antenna or antennas and the electromagnetic wave transmission structure being formed by integrated circuit techniques.

In one embodiment, the TIC of these teachings represents a much more compact, less expensive, low power, solution for performing THz spectroscopy of small amounts of material, compared to the present conventional systems.

A number of other embodiments are also disclosed.

For a better understanding of the present teachings, together with other and further needs thereof, reference is made to the accompanying drawings and detailed description and its scope will be pointed out in the appended claims.

DETAILED DESCRIPTION

The following detailed description presents the currently contemplated modes of carrying out the invention. The description is not to be taken in a limiting sense, but is made merely for the purpose of illustrating the general principles of the invention.

As used herein, the singular forms "a," "an," and "the" include the plural reference unless the context clearly dictates otherwise.

Except where otherwise indicated, all numbers expressing quantities of ingredients, reaction conditions, and so forth used in the specification and claims are to be understood as being modified in all instances by the term "about."

Figure 1A:
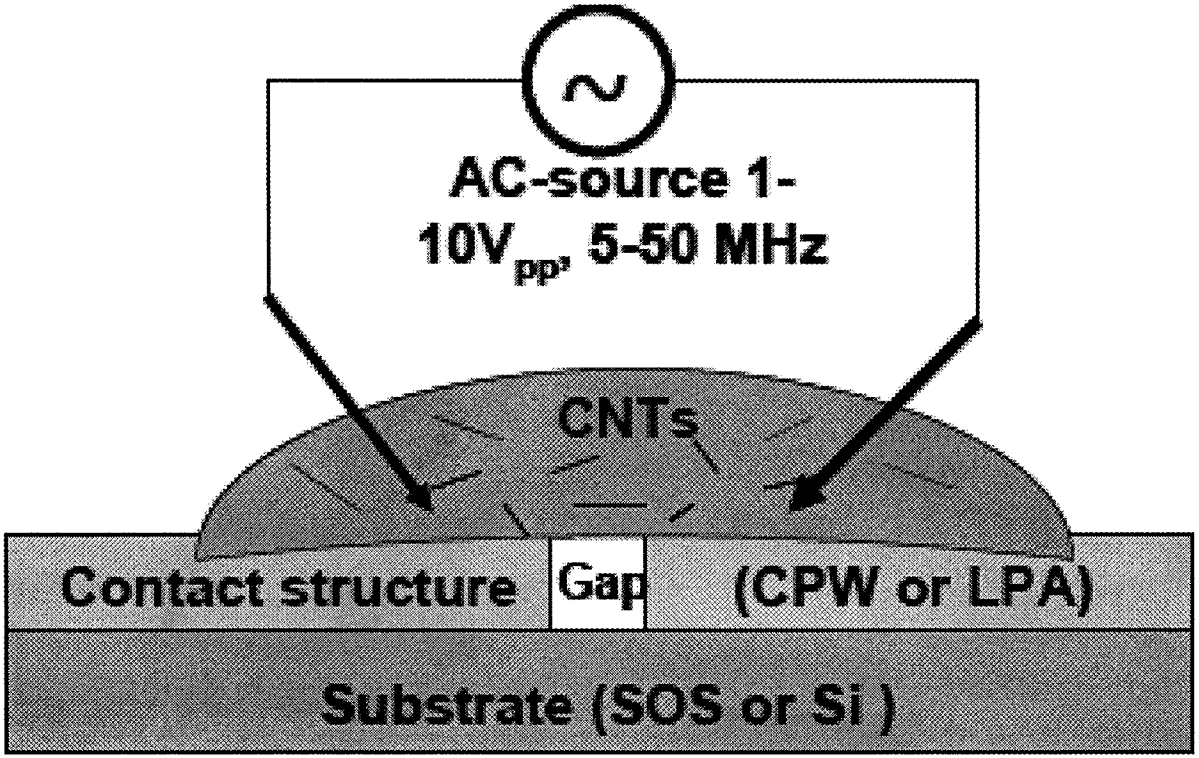
FIG. 1*a* is a graphical schematic representation of one embodiment of the component of the system and method of these teachings.

Emission of terahertz radiation has been observed from Joule heated single walled carbon nanotube (SWCNT) network deposited in a micron sized gap across conducting surfaces. The SWCNT is heated by a low (1-10 V) DC voltage source that is turned on and off at a low frequency (in the range of 100 Hz) (see, for example, M. Muthee, E. Carrion, J. Nicholson, and S. K. Yngvesson, "Antenna-coupled terahertz radiation from joule-heated single-wall carbon nanotubes" AIP Advances 1, 042131 (2011) or Muthee, M., Yngvesson, S. K., "Terahertz radiation from antenna-coupled Single Walled Carbon Nanotubes", 2011 36th International Conference on Infrared, Millimeter and Terahertz Waves (IRMMW-THz), 2011, pp. 1-2, both of which are incorporated by reference herein in their entirety for all purposes, and also provided in the Appendix). The SWCNTs are purchased from a commercial source and are dispersed in de-ionized water. They are then contacted to the conducting surfaces by a dielectrophoretic process that applies an RF voltage of a few volts at about 5 MHz to the two sections of the conducting surfaces as a drop of the SWCNT dispersion is placed on the antenna. The RF voltage attracts the SWCNTs to the smallest gap across the conducting surfaces, and favors the selection of metallic SWCNTs, which are more efficient for THz radiation than semiconducting SWCNTs (See FIG. 1*a* and FIG. 1*d*). Similar results can be obtained using other conductive components such as at least one strip of palladium, at least one strip of platinum or at least one exfoliated graphene sheet.

In one or more embodiments, the system of these teachings includes an electromagnetic wave transmission structure having a first end and a second end, conducting components, the conducting components selected from at least one of a network of carbon nanotubes, at least one strip of palladium, at least one strip of platinum or at least one exfoliated graphene sheet, deposited across a location in a wave transmission section of the wave transmission structure (also referred to as a gap), and an antenna electromagnetically coupled to the electromagnetic wave transmission structure at one of the first or second end, the antenna and the electromagnetic wave transmission structure being formed by integrated circuit techniques.

In one instance, the electromagnetic wave transmission structure is a microstrip line.

In another instance, the electromagnetic wave transmission structure is a coplanar waveguide transmission line.

In one instance, the antenna is a slot antenna. In one embodiment the antenna is a slot bowtie antenna.

In one or more embodiments, the method of these teachings includes depositing conductive components, the conducting components selected from at least one of a network of carbon nanotubes, at least one strip of palladium or at least one strip of platinum, across a gap in an electromagnetic wave transmission structure and coupling an antenna to the electromagnetic wave transmission structure to a first or second end of the electromagnetic wave transmission structure, the antenna and the electromagnetic wave transmission structure being formed by integrated circuit techniques.

In one instance, the carbon nanotube network is deposited by a dielectrophoretic process (DEP).

In another instance, at least one narrow palladium strip is fabricated using electron beam lithography.

In yet another instance, at least one mechanically exfoliated graphene sheet is placed across a location in a wave transmission section of the wave transmission structure (also referred to as a gap).

Exemplary embodiments are presented herein below in order to illustrate the present teachings. It should be noted that these teachings are not limited only to the exemplary embodiments.

In one exemplary embodiment, the SWCNTs are deposited in a gap in a microstrip line defined on a silicon chip, with a thin layer of silicon oxide as dielectric.

Figures 1B, 1C:
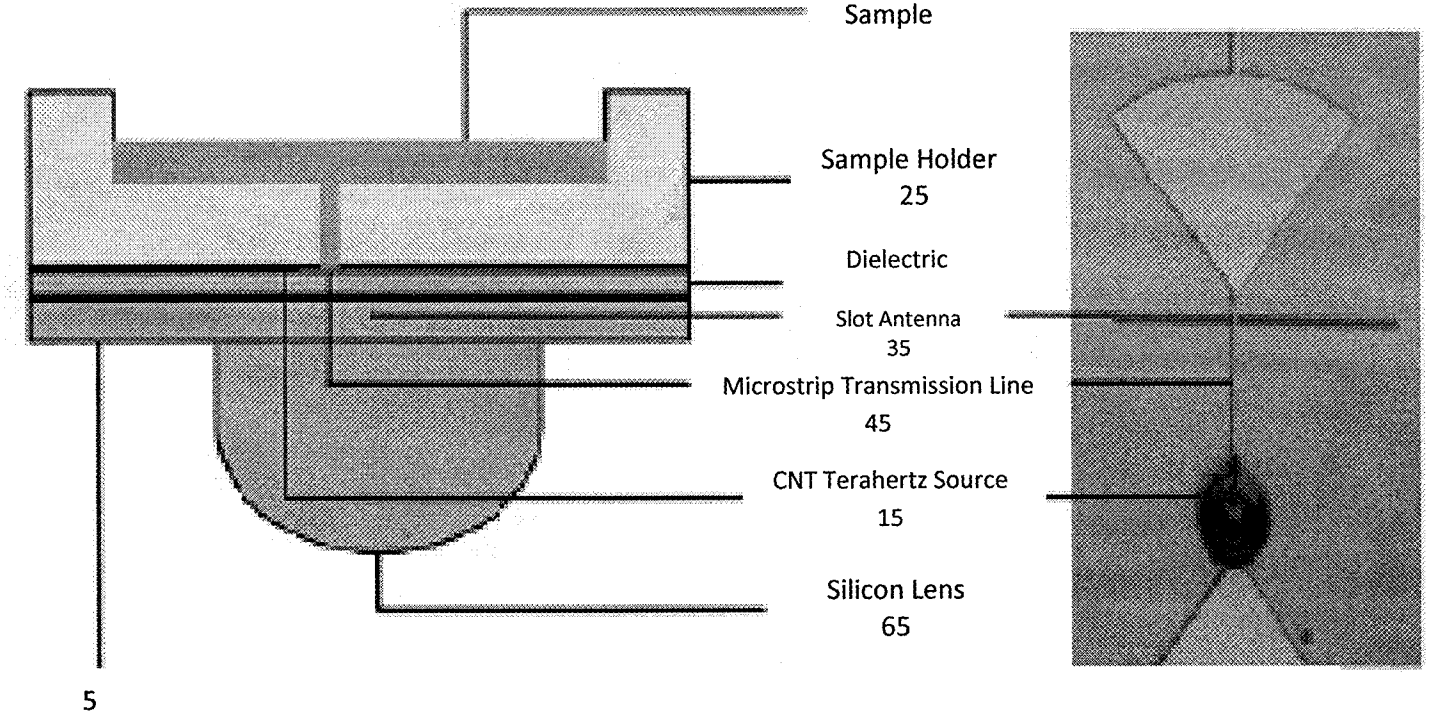
FIG. 1*b*-1*d* are graphical and pictorial representations of one embodiment of the system of these teachings.
Figure 1D:
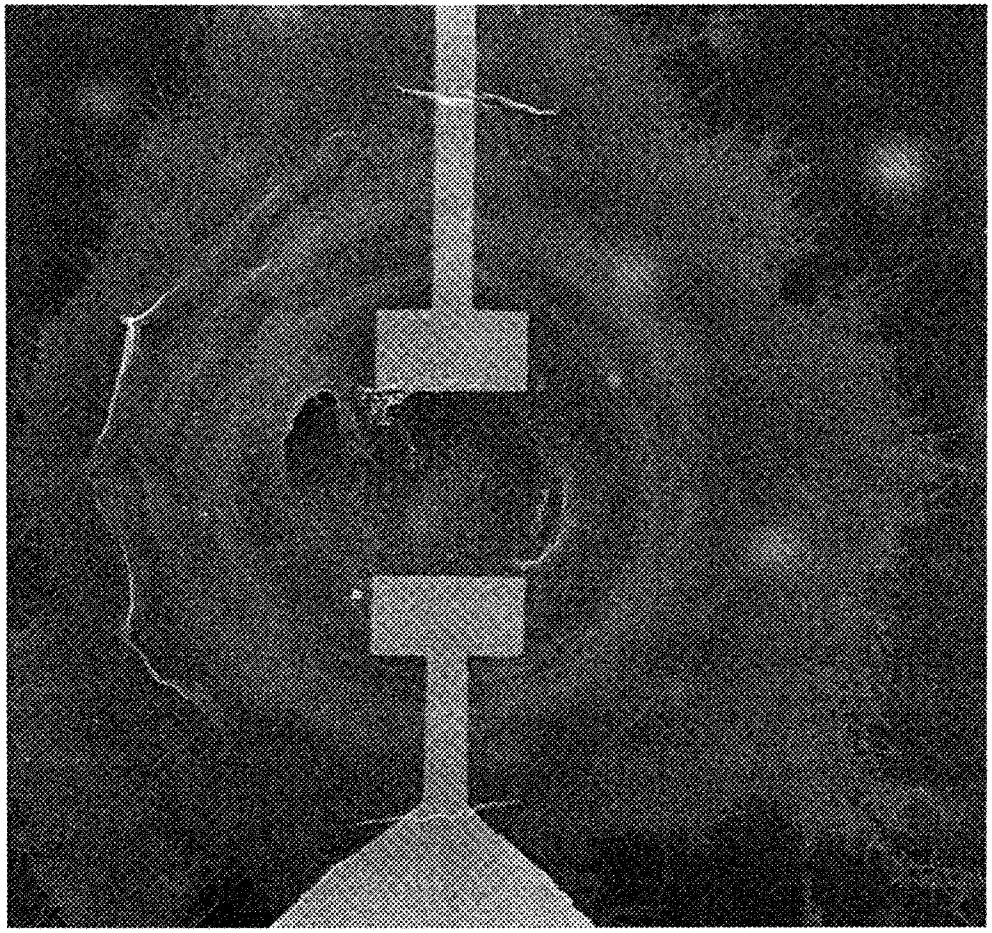
Figure 1E:
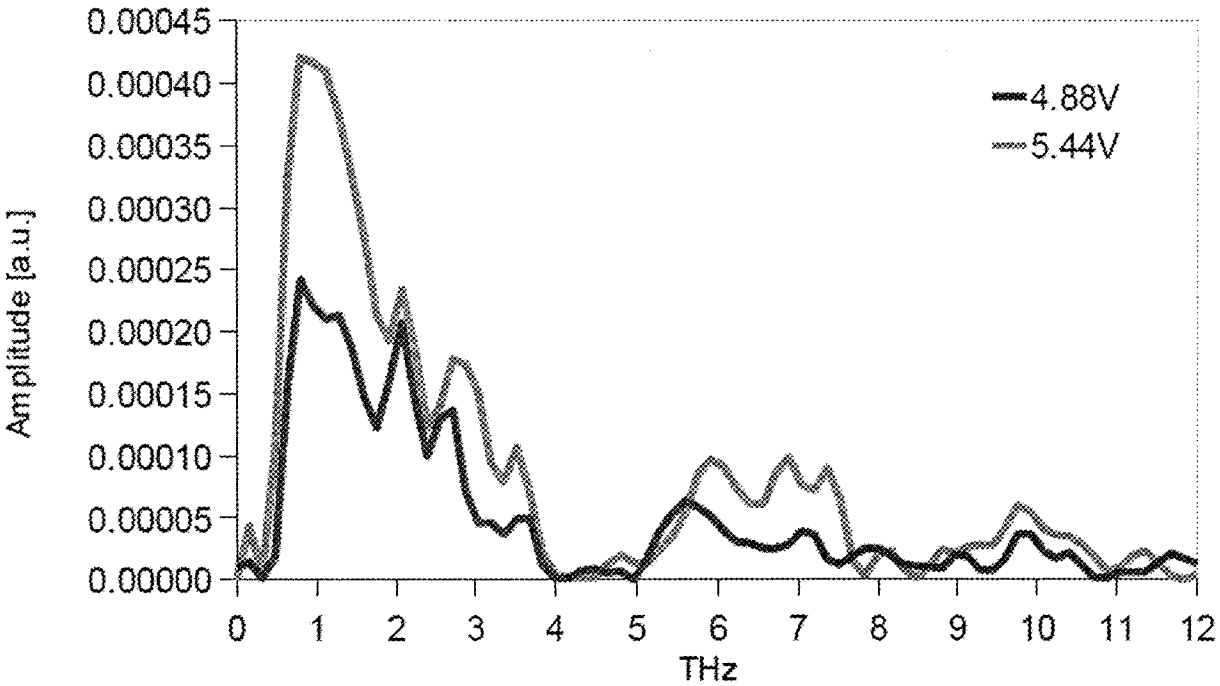
FIG. 1*e* is a graphical representation of results obtained with this embodiment of these teachings.

FIGS. 1*b*-1*e* show one exemplary embodiment of the system of these teachings. Referring to FIGS. 1*b*-1*d*, a Terahertz IC (TIC) with a conductive element 15 (a CNTS in the embodiment shown) (black small dot in optical photograph in FIG. 1*d*) connected to an antenna (a resonant slot antenna in the embodiment shown) 35 through an electromagnetic wave transmission structure 45 (a microstrip transmission line in the embodiment shown), also shown in the optical photograph to the right of the drawing. A small container 25 is lithographically fabricated on top of the silicon wafer 5 with its microstrip line TIC, for spectral measurements of different materials, as indicated in the FIG. 1*b*; FIG. 1*d* shows SEM picture that shows a magnified view of the SWCNT source in the THz IC before the microstrip circuit was fabricated. FIG. 1*e* shows Spectra measured for the THz IC at two different bias voltages, as marked. No material was applied to the TIC in this case.

Radial stubs 55 at either end of the microstrip line are used for introduction of the DC bias (FIG. 1*b*). The microstrip is coupled to a resonant slot antenna fabricated in the gold ground-plane of the microstrip, thus forming the Terahertz Integrated Circuit (TIC). Typical size of the TIC is 100 μm×300 μm to 100 μm×700 μm. The antenna radiates through the backside of the substrate into a silicon lens 65. The radiation is coupled into the Fourier Transform Spectrometer and FIG. 1*d* shows a typical measured spectrum that extends to 11 THz.

In another exemplary embodiment, the TIC consists of a Coplanar Waveguide (CPW) transmission line connected to a bow-tie slot-antenna.

Figure 2A:
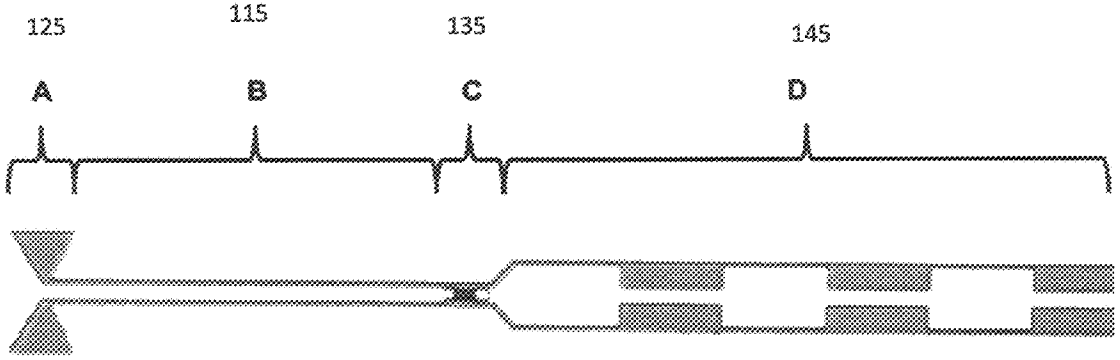
FIGS. 2*a*-2*b* are graphical and pictorial representations of another embodiment of the system of these teachings.
Figure 2B:
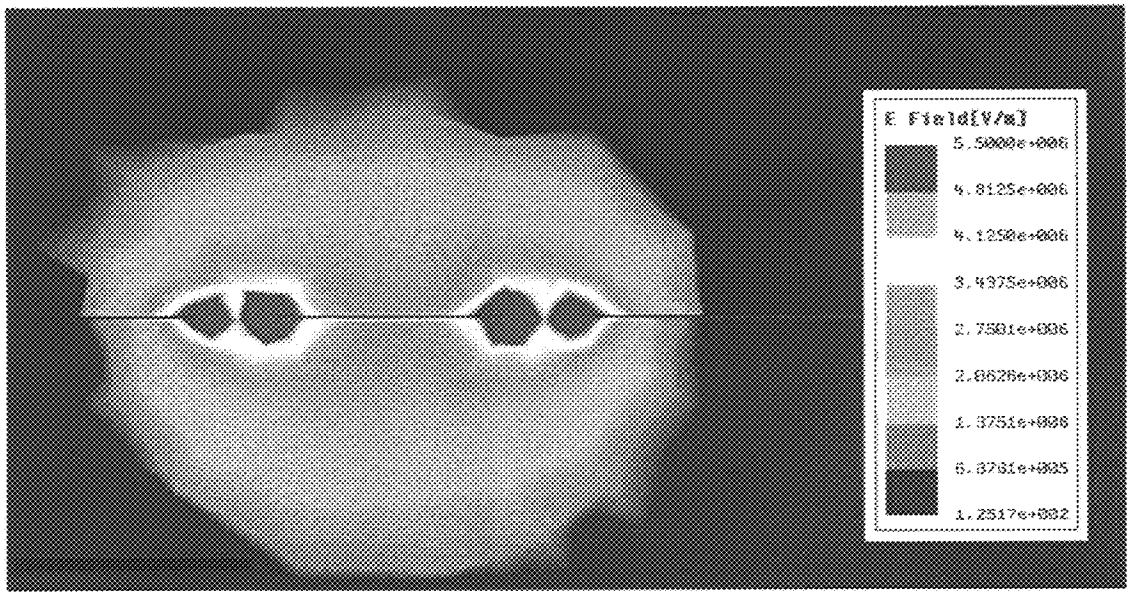
Figure 3:
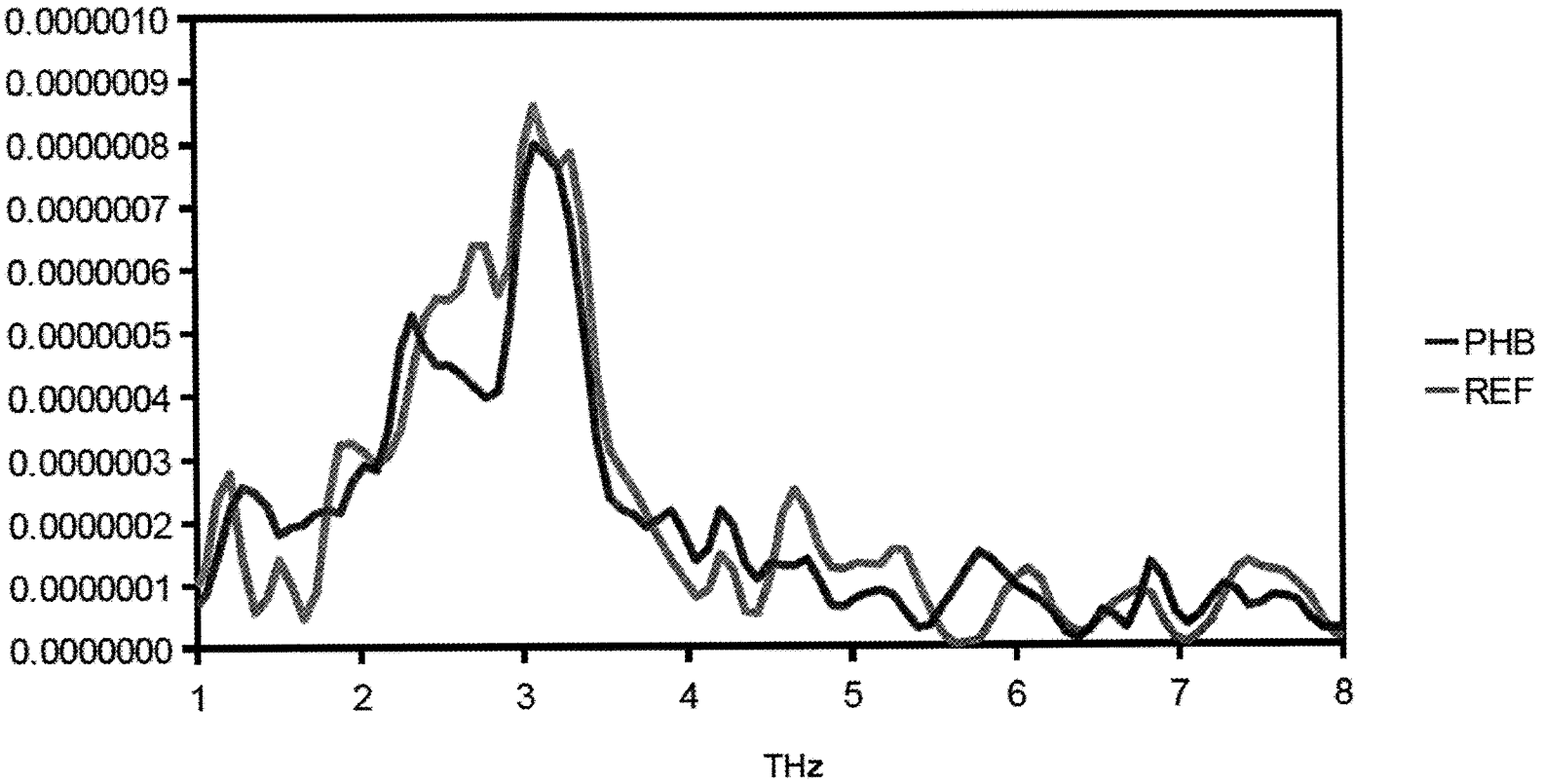
FIG. 3 is a graphical representation of results obtained using the embodiment of FIG. 2*a;*

FIGS. 2*a*-2*b* and 3 show another exemplary embodiment of the system of these teachings. Referring to FIGS. 2*a*-2*b*, FIG. 2*a* shows a Coplanar Waveguide TIC (CPW 115, a ground-signal-ground transmission line) connected to a bow-tie slot-antenna 125 (at left end of the CPW); the picture was taken before applying SWCNTs 135 at the small gap; a filter (low pass filter) 145, visible to the right of the gap, is also used to introduce bias without losing the THz power from the circuit. FIG. 2*b* shows HFSS simulation of the THz electric field distribution on the CPW. FIG. 3 shows THz spectra of the crystalline polymer PHB (polyhydroxybutyrate) measured by this TIC. The PHB powder was sprinkled onto the CPW. The red curve shows the reference spectrum without PHB, and the blue curve the spectrum with PHB.

In this exemplary embodiment, devices were fabricated on a high resistivity Silicon substrate, using E-beam lithography to define the pattern followed by a metallization step. SWCNTs were deposited by dielectrophoresis (DEP) and typical device resistance ranged from 200-500 Ohms based on DEP conditions. To limit DEP to the gap in the signal line, as shown in part C in FIG. 2*a*, a window was defined in photoresist, again using E-beam lithography. After the DEP process the device was soaked in acetone for a few minutes and subsequently rinsed with IPA and DI water. Finally the devices were annealed in an oven for 2 hours at 200° F. The complete integrated circuit, as shown in FIG. 2*a*, includes a low-pass filter (D) and a 100 um long CPW (B) terminated with a slot-bowtie antenna (A). The SWCNT source is located at (C). The dimensions of the CPW gap and signal line width were chosen such that the impedance closely matched the dc resistance of the SWCNT source. This impedance matching allows for maximal power transmission from the source to the CPW to the antenna.

In an initial experimental demonstration of the above exemplary embodiment, THz spectra of the crystalline polymer PHB (polyhydroxybutyrate) have been measured by the TIC and are shown to in FIG. 3. The PHB powder was sprinkled onto the CPW of the TIC to perform this test. The red curve shows the reference spectrum without PHB, and the blue curve the spectrum with PHB. Two absorption lines at 2.5 THz and 2.9 THz respectively, characteristic of PHB, are clearly evident, giving proof of the intended function of the TIC which is to measure THz spectra of very small amounts of materials. (Other measurements obtained using the above exemplary embodiment are described in Muthee, M., Yngvesson, S. K., "On-chip THz spectroscopy of Polyhydroxybutyrate (PHB) powder", 2013 38th International Conference on Infrared, Millimeter and Terahertz Waves (IRMMW-THz), Sep. 1-6, 2013, which is incorporated by reference herein in its entirety and for all purposes.)

Figure 4:
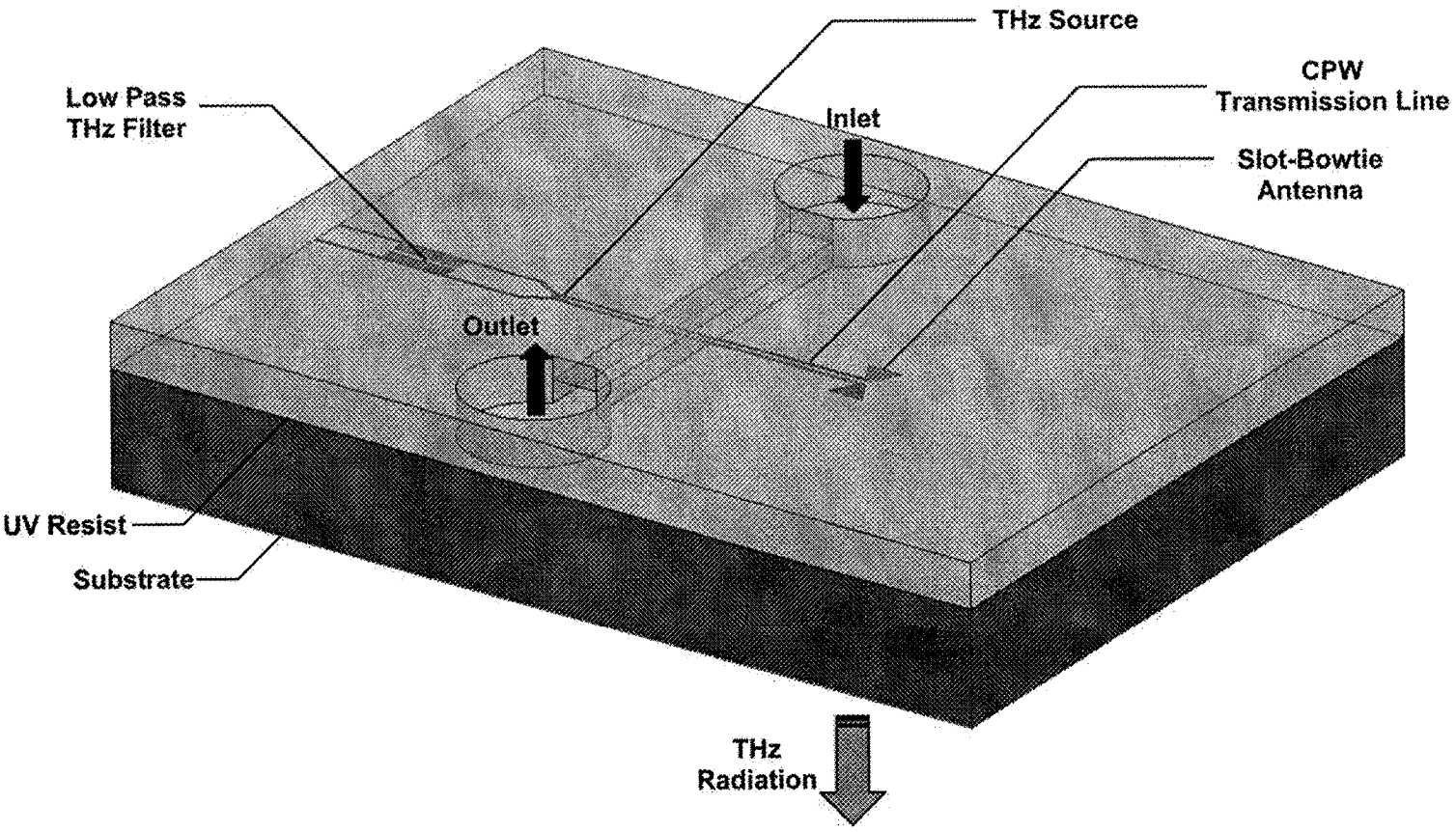
FIG. 4 is a graphical schematic representation of yet another embodiment of the system of these teachings.

In yet another exemplary embodiment, a TIC of either one of the two above embodiments, integrated with a nano/micro-fluidic channel FIG. 4 shows an instance of this yet another exemplary embodiment in which the material to be measured is in liquid form and will be introduced through one or several nano/micro fluidic channels. Narrow THz spectral signatures of an RNA solution that flowed through a nanofluidic channel were previously measured in a much more complex photomixer based system. This type of measurement can be performed in the ultra-compact TIC device of this type at much lower cost.

Hereinbelow, results are presented for THz emission from thin films in which the maximum output power that can be reached and any spectral differences that exist, specifically in SWCNT, Graphene and Palladium or Platinum thin films are comparatively explored.

Figures 5A, 5B, 5C, 5D:
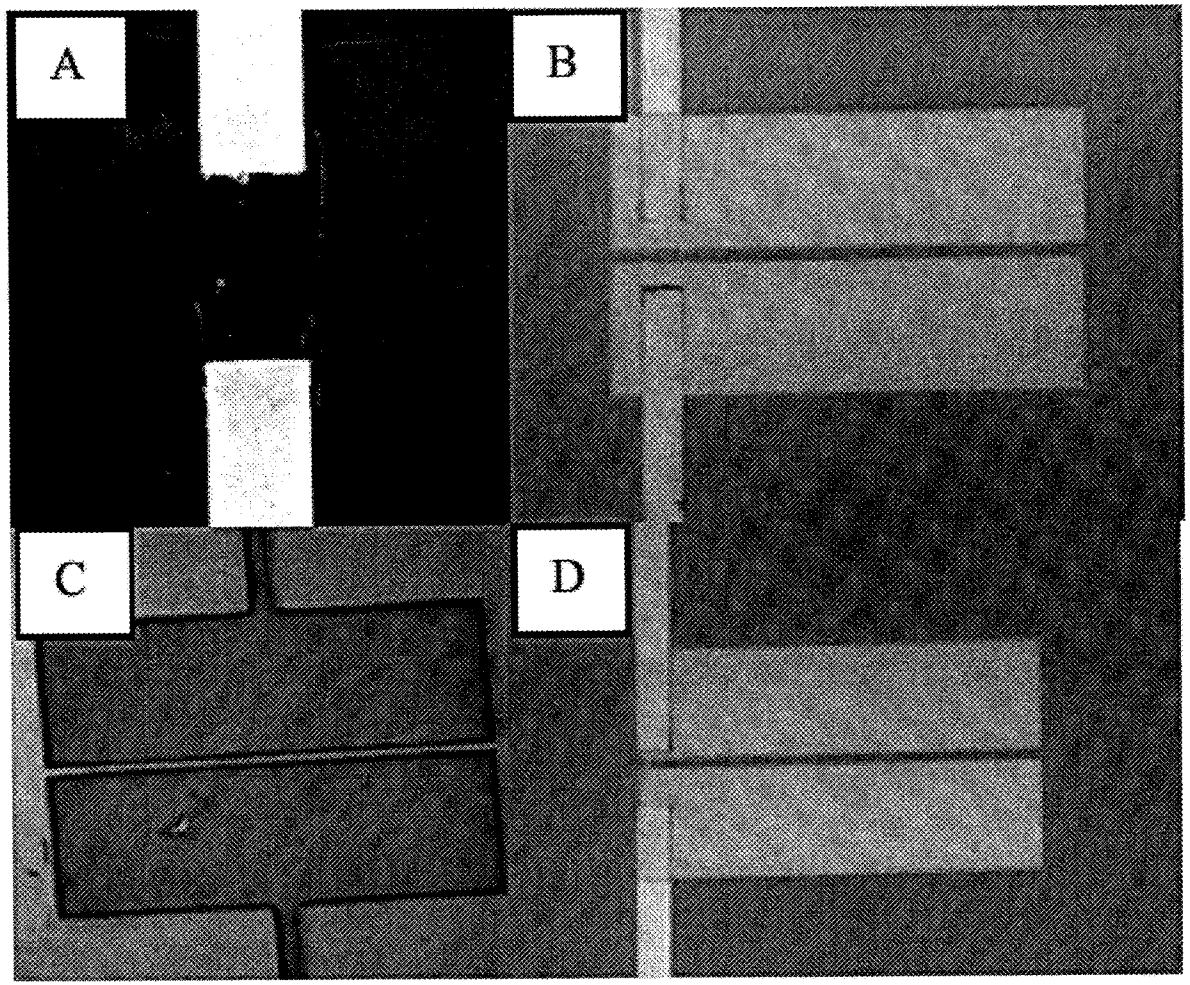
FIG. 5(A) shows an SEM image showing DEP result (gap is 5 um)
FIG. 5(B) shows an optical image of device (A) after Palladium deposition.
FIG. 5(C) shows an optical image of graphene device after EBL.
FIG. 5(D) shows an optical 1 image of Palladium based device (gaps in FIGS. 5B,C,D are 1 um)

In one instance, SWCNTs are placed on gold leads through dielectrophoresis (DEP), which selectively deposits metallic SWCNTs. FIG. 5*a* shows an SEM image after DEP. In another instance Palladium or Platinum strips are patterned using e-beam lithography (EBL) and connected to Gold, Palladium or Platinum leads. The effective electric gap is subsequently reduced to 1 um. FIG. 5*b* shows a typical SWCNT based source after Palladium deposition. Typical device resistances are in the hundreds of Ohms (>300 Ohms) depending on the DEP conditions. Graphene devices are made from mechanically exfoliated graphene with a series of EBL steps to define alignment marks, contact leads and the antenna pattern. FIG. 5*c* shows a device prior to metallization with a monolayer graphene sheet seen at the center. Typical device resistances range between 200-1 KOhm. Palladium and Platinum devices are also fabricated using EBL, with one or more antenna patterns shorted on one end by a narrow palladium strip as shown in FIG. 5(*d*). Typical Pd and Pt device resistances are about 200 Ohms.

The radiation from the antenna is coupled through a silicon lens and produces a collimated THz beam. The bandwidth and center frequency are determined by the antenna dimensions and are measured with a Fourier-transform spectrometer.

Based on simulation results, an edge fed antenna is selected for use, where the source is localized on one end as it presents a single well-defined resonance over a wide bandwidth. This type of antenna has also been described in H. Yordanov and P. Russer, "Integrated on-chip antennas using CMOS circuit ground planes," Proc. 10th Topical Meeting on Silicon Monolithic Integrated Circuits in RF Systems, New Orleans, La., January 2010, pp. 53-56, which is Incorporated by reference herein in its entirety and for all purposes Power measurements are made using a Golay cell and table 1 below shows measurement results for a sample of devices.

TABLE 1

| Device | Bias (V) | Power (nW) |
|---|---|---|
| Palladium | 1.4 | 15 |
| Graphene (Single | 3.12 | 35 |
| SWCNT (Single | 3.2 | 30 |

While the embodiments disclosed herein above described the fabrication and use of one emitting source of terahertz radiation, by the same method the system can be repeated in order to form an array of terahertz sources. Such an embodiment produces a higher power of terahertz emission, where powers, for example, but not limited to, of several microwatts, can be achieved.

Figure 6:
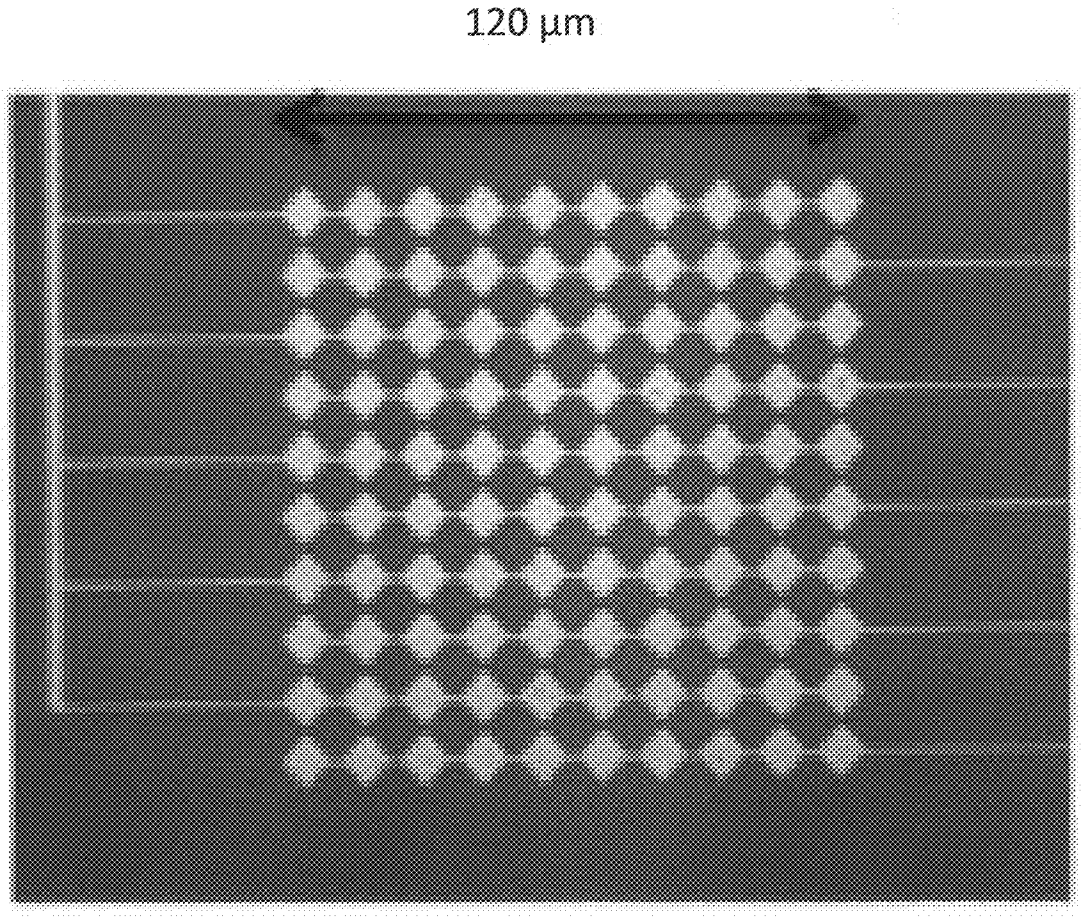
FIG. 6 shows an array THz source with CNT radiating elements.
Figure 7:
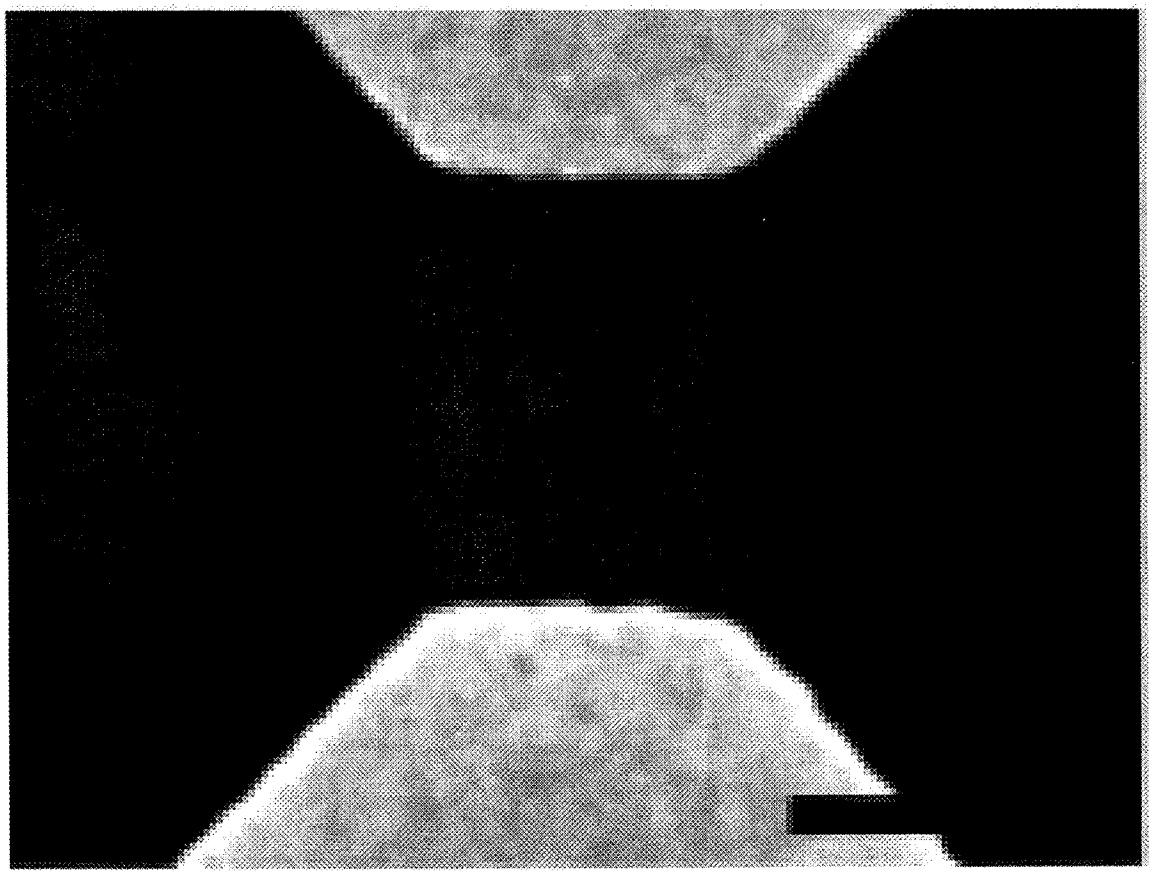
FIG. 7 shows an embodiment of one of the elements in the array of FIG. 6; The scale bar is 1 μm.
Figure 8:
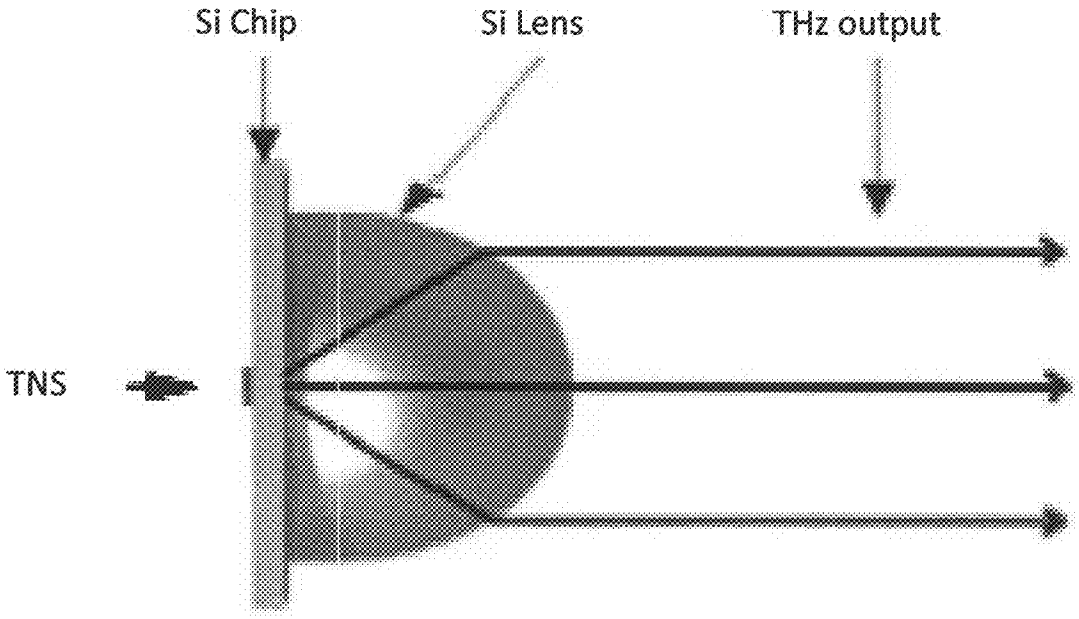
FIG. 8 shows a schematic presentation of an embodiment of the system in which an array terahertz source provides electromagnetic radiation.

An array of sources is shown in FIG. 6, in the embodiment shown in FIG. 6, the array of terahertz sources has 90 elements. Bias is applied to the wires at the left and right. In one exemplary embodiment, carbon nanotubes (CNT) used and each element in the array includes a bow-tie antenna operatively connected to a network of CNTs that have been deposited as described hereinabove, by dielectrophoresis (FIG. 1*c*), as shown in FIG. 7. In one instance, THz array ("TNS") radiates through the silicon substrate (chip) and a silicon lens (as in FIG. 1*c*), shown FIG. 8.

In another instance, each element in the array includes a dipole antenna operatively connected to a network of CNTs that have been deposited as disclosed herein above.

Figure 9:
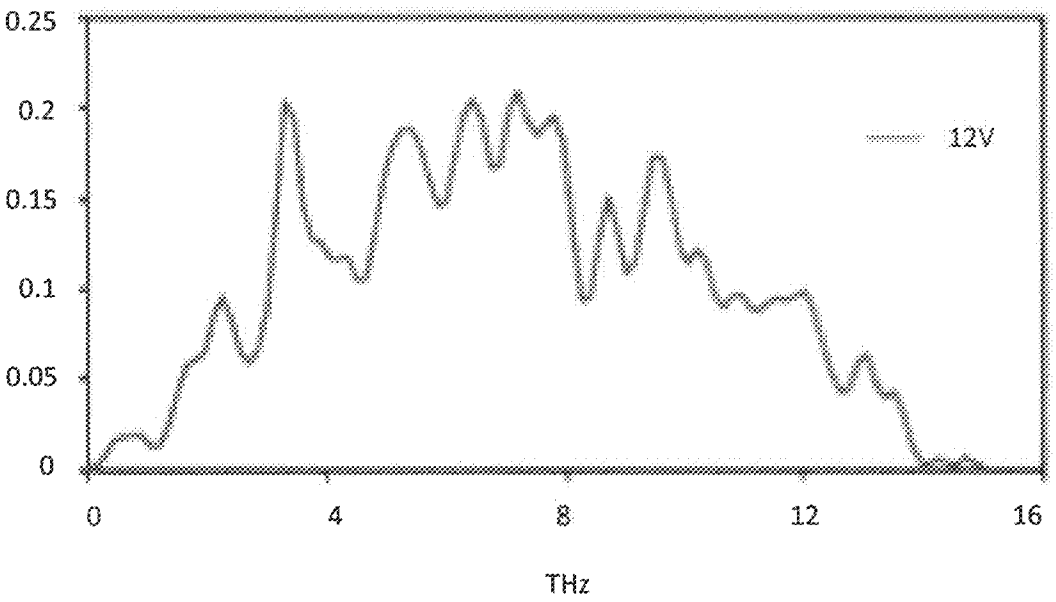
FIG. 9 shows measured spectrum for a 90 element THz array source with platinum elements.

In other embodiments, the radiating elements are Palladium or platinum nanowires operatively connected to antennas as disclosed herein above. FIG. 9 shows a spectrum from such a THz source. The spectrum extends to 14 THz, unique for the Pt type of source, much wider than for the CNT source described above.

Figure 10:
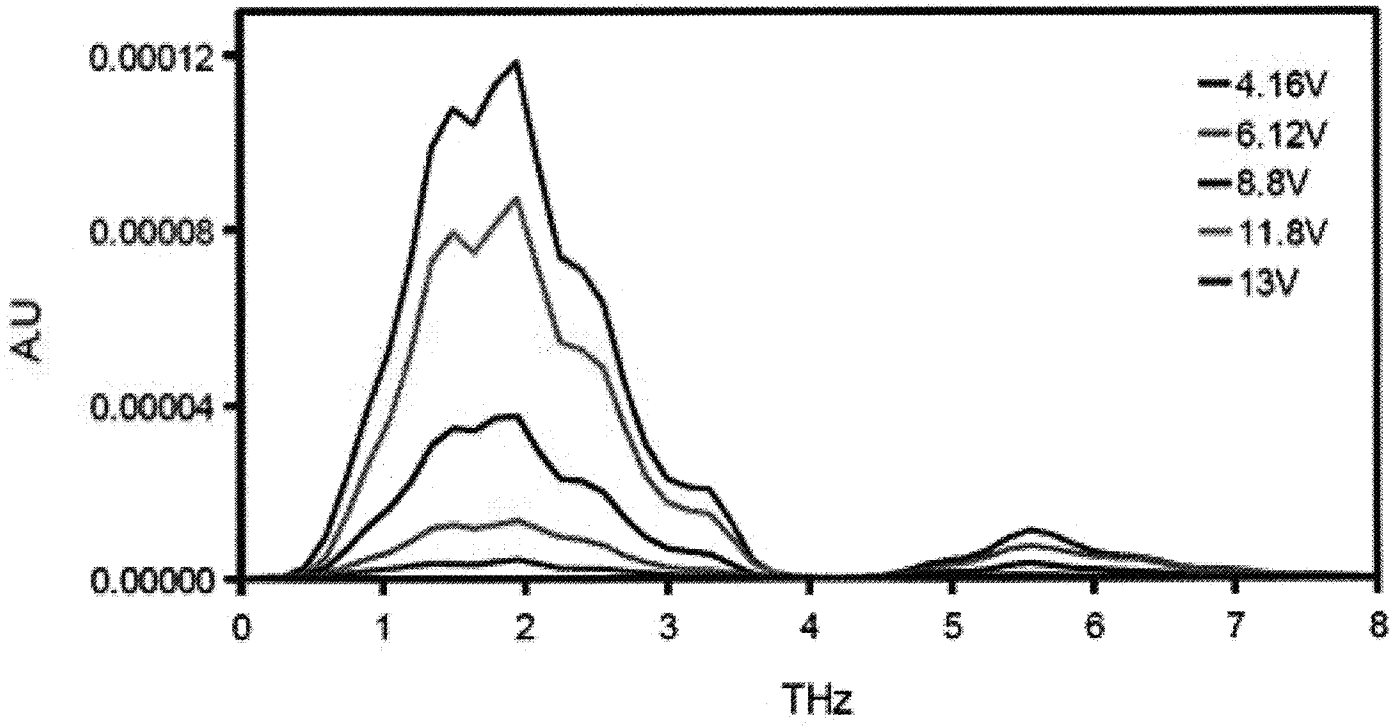
FIG. 10 shows measured spectrum from a source such as the one shown in FIG. 6, plotted for different bias voltages.

Spectroscopy can be performed by placing objects in the THz output beam and inserting a Fourier transform spectrometer (FTS) and a THz detector behind the object. The FTS and the THz detector would be similar to what was used in the preliminary patent application to obtain spectra such as in FIG. 3. FIG. 10 shows the spectrum measured directly of the output from one of the THz sources.

The array sources disclosed herein above can be used as sources in a terahertz communication system or in a terahertz imaging system.

Although the teachings have been described with respect to various embodiments, it should be realized these teachings are also capable of a wide variety of further and other embodiments within the spirit and scope of the appended claims.

The invention claimed is:

1. A system for terahertz radiation emission, the system comprising:

an electromagnetic wave transmission structure having a first end and a second end;

conducting components, the conducting components selected from at least one of at least one strip of palladium, at least one strip of platinum, platinum nanowires or palladium nanowires, the conducting components being deposited across a location in a wave transmission section of the wave transmission structure, also referred to as a gap; the conducting components configured to emit terahertz radiation upon Joule heating of the conducting components; the conducting components constituting a source of terahertz radiation; and one or more antennas electromagnetically coupled to the electromagnetic wave transmission structure at one of the first or second end; the conducting components being coupled to the one or more antennas through the electromagnetic wave transmission structure;

a filter configured to introduce bias voltage, the filter being electromagnetically coupled to another one of the first or second end;

the one or more antennas, the filter and the electromagnetic wave transmission structure being formed by integrated circuit techniques.

2. The system of claim 1 further comprising a silicon substrate on which the electromagnetic wave transmission structure, the conducting components and the one or more antennas are disposed.

3. The system of claim 2 further comprising a silicon lens operatively disposed on an opposite side of the silicon substrate; the silicon lens being operatively disposed to receive electromagnetic radiation from the one or more antennas.

4. The system of claim 1 wherein the one or more antennas are one or more slot antennas.

5. The system of claim 1 wherein the one or more antennas are one or more bowtie antennas.

6. The system of claim 1 wherein the one or more antennas are one or more dipole antennas.

7. The system of claim 1 wherein the electromagnetic wave transmission structure is a microstrip line.

8. The system of claim 1 wherein the electromagnetic wave transmission structure is a coplanar waveguide transmission line.

9. The system of claim 1 wherein the conductive components comprise at least one strip of palladium.

10. The system of claim 1 wherein the conductive components comprise at least one strip of platinum.

11. The system of claim 1 wherein the filter comprises radial stubs.

12. The system of claim 1 wherein the filter is a low pass filter.

13. A method for fabricating a terahertz integrated circuit for terahertz radiation emission, the method comprising:

depositing conductive components, the conducting components selected from at least one strip of palladium, at least one strip of platinum, platinum nanowires or palladium nanowires, across a gap in an electromagnetic wave transmission structure; the conducting components emitting terahertz radiation upon Joule heating of the conducting components; the conducting components constituting a source of terahertz radiation;

coupling one or more antennas to the electromagnetic wave transmission structure to one of a first or second end of the electromagnetic wave transmission structure, the one or more antennas radiating the terahertz radiation; and, coupling a filter to another one of the first or second end of the electromagnetic wave transmission structure;

the one or more antennas, the filter, and the electromagnetic wave transmission structure being formed by integrated circuit techniques.

14. The method of claim 13 wherein the conducting components comprise at least one strip of palladium.

15. The method of claim 14 wherein at least one palladium strip is fabricated using electron beam lithography.

16. The method of claim 13 wherein the conducting components comprise at least one strip of platinum.

17. The method of claim 16 wherein at least one platinum strip is fabricated using electron beam lithography.

* * * * *